US005518471A

United States Patent [19]

Hettinger et al.

[11] Patent Number: 5,518,471

[45] Date of Patent: May 21, 1996

[54] EXERCISE TREADMILL WITH REARWARDLY PLACED INCLINE MECHANISM

[75] Inventors: Ronald K. Hettinger, Poulsbo, Wash.; Tero M. Piispanen, Turku, Finland

[73] Assignee: Tunturi, Inc., Redmond, Wash.

[21] Appl. No.: 383,212

[22] Filed: Feb. 2, 1995

Related U.S. Application Data

[63] Continuation-in-part of Ser. No. 30,746, Nov. 7, 1994.

[51] Int. Cl.[6] ..... A63B 22/02

[52] U.S. Cl. ..... 482/54; 482/51

[58] Field of Search ..... 482/54, 51

[56] References Cited

U.S. PATENT DOCUMENTS

| | | | |
|---|---|---|---|
| 4,974,831 | 12/1990 | Dunham | 482/54 |
| 5,192,255 | 3/1993 | Dalebout et al. | 482/54 |
| 5,385,520 | 1/1995 | Lepine et al. | 482/54 |

FOREIGN PATENT DOCUMENTS

| | | | |
|---|---|---|---|
| 0825122 | 4/1981 | U.S.S.R. | 482/54 |

*Primary Examiner*—Lynne A. Reichard

*Attorney, Agent, or Firm*—Graybeal Jackson Haley & Johnson

[57] ABSTRACT

Exercise treadmills with stationary, forwardly placed supporting surface engaging foot means of fixed form and with rearwardly placed supporting surface engaging support means which are movable relative to the frame of the treadmill to change the angular relation of the frame and the treadmill tread belt relative to the supporting surface. The change in incline of the treadmill tread belt is by either electrical power means involving an extensible jack mechanism or by manually operable means including a gas cylinder with an extensible piston rod movable by gas flow within the cylinder which is in turn controlled by manually operable valve means. When gas can flow within the cylinder, change in incline of the treadmill tread belt is accomplished by the treadmill user moving relatively forwardly or rearwardly on the treadmill belt.

6 Claims, 8 Drawing Sheets

EXERCISE TREADMILL WITH REARWARDLY PLACED INCLINE MECHANISM

CROSS-REFERENCE TO RELATED APPLICATION

This application is a continuation-in-part of U.S. design patent application Ser. No. 29/030,746, entitled Exercise Treadmills, and filed Nov. 7, 1994.

BACKGROUND OF THE INVENTION

1. Field of the Invention

The present invention relates to exercise treadmills and more particularly to such treadmills wherein the plane off the tread belt of the treadmill is variable by means of rearwardly placed slope or incline adjustment mechanism.

2. Description of the Prior Art

Exercise treadmills conventionally have tread belt user support surfaces which either have a fixed attitude relative to the support surface on which the treadmill rests user which have mechanism to adjust the incline of the tread belt by means relatively raising or lowering the front or forward end of the treadmill and tread belt. Many examples of such treadmills are known, such as disclosed in Chen U.S. Pat. No. 4,792,134 and Dalebout U.S. Pat. No. 5,062,632, for example. Customarily, also, many treadmills which are inclinable by being raised and lowered at the front end are also provided with a raised deck portion forwardly of the tread belt in which the tread belt drive motor, and sometimes the incline drive motor as well, are housed. One example of this type of arrangement are shown in Chen U.S. Pat. No. 4,792,134, for example, Also of interest in the prior art is Weisz U.S. Pat. No. 5,295,929 which discloses an underwater treadmill for hydrotherapy usage. This treadmill has a tread belt platform which is supported by a roller frame which in turn is supported by vertically extensible pneumatic cylinders or other suitable mechanical devices so that it can be tilted lengthwise. This patent thus may be said to teach the broad proposition of tilting a treadmill tread bed by raising or lowering either the forward or the rearward end of the tread deck. However, this patent does not disclose how this would be done on an exercise treadmill with a fixed forward support and its disclosure is of a special purpose assembly in which a user is partly submerged in a tub for rehabilitative hydrotherapeutic purposes.

SUMMARY OF THE INVENTION

A treadmill according to the present invention differs from conventional exercise treadmills in that its tread height at the front end of the tread belt is fixed and its incline drive mechanism is situated to act on the rearward end of the treadmill. Being of fixed height and substantially above the floor level, the front end of the treadmill can house the tread belt drive motor entirely below the tread belt plane so that the tread belt can be completely flat end for end and extend completely from one end of the treadmill to the other. To effect such an arrangement, the forward end of the treadmill is supported by a fixed support, and slung under the treadmill frame rearwardly are pivotally movable arms, the angular position of which is variable by means of shortening or lengthening of an extensible, electric motor driven assembly, in one version of the treadmill. In this form, when the extensible incline drive assembly is of maximum length, the arms are moved to a location nested under and between the sides of the treadmill frame, in which position the tread belt has its maximum incline.

A modified from of treadmill according to the invention involves control of the position of the pivotally movable incline mechanism arms by means of an extensible gas cylinder and piston rod, the relative length of which is in turn determined by gas flow from one end of the cylinder to the other through valve means manually opened or closed by the user, with change in incline being caused by manual change of position of the user forwardly or rearwardly on the tread belt. This essentially manual control mechanism has the advantage of being quite simple and straightforward for the purpose. On the other hand, the utilization of an electric motor drive for incline adjustment mechanism, as is characteristic of the first form of treadmill incline control discussed, has the advantage that it can be re-programmed.

These and other features, advantages and characteristics of inclinable treadmills according to the resent invention will be apparent from the following description and accompanying drawings relating to the referred embodiments thereof.

DESCRIPTION OF THE PREFERRED EMBODIMENTS

Figure 1:
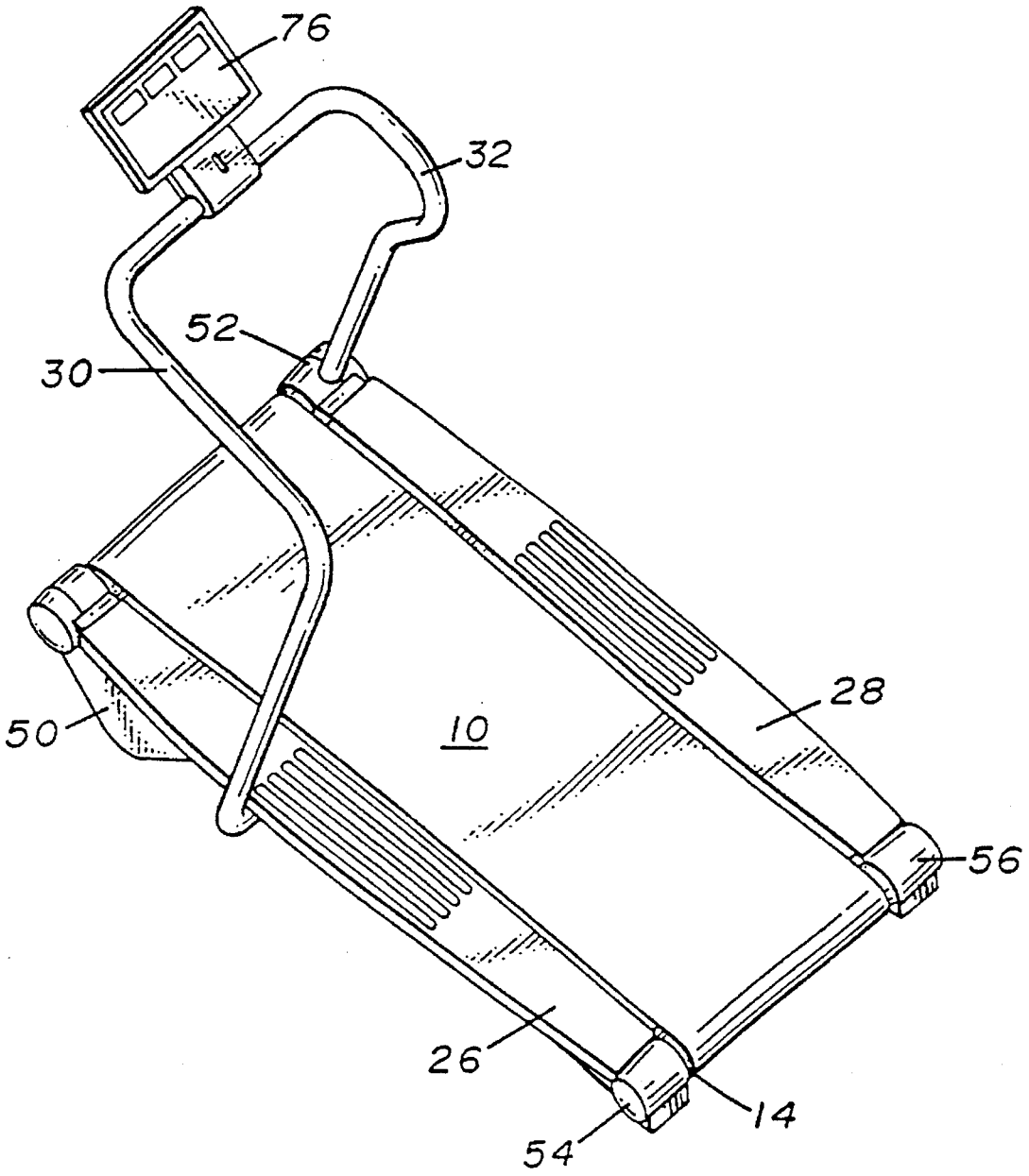
FIG. 1 is an isometric view of a treadmill according to the present invention, from an upward and somewhat rearward aspect, showing the first preferred embodiment thereof.
Figure 2:
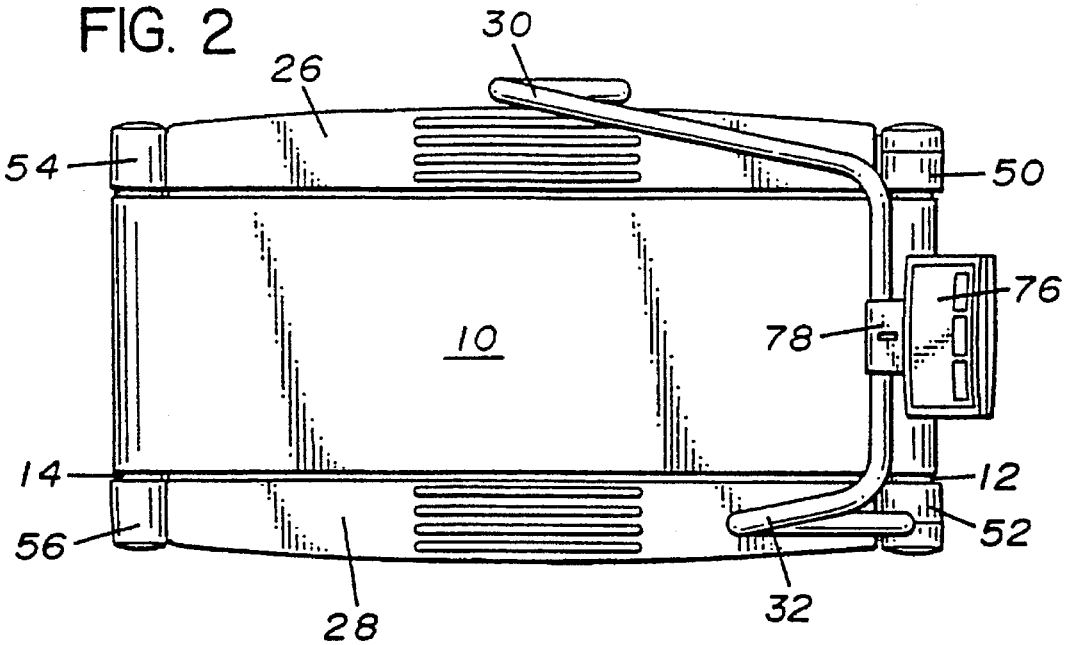
FIG. 2 is a top plan view thereof.
Figure 3:
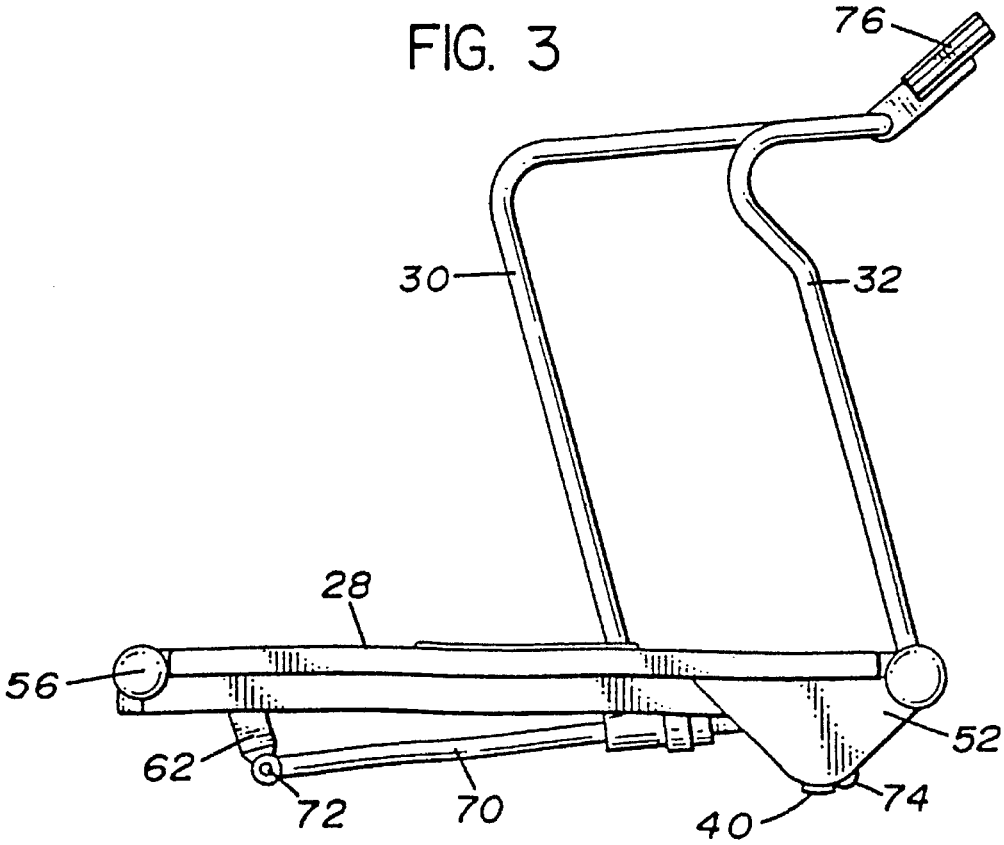
FIG. 3 is a right side elevational view thereof.
Figure 4:
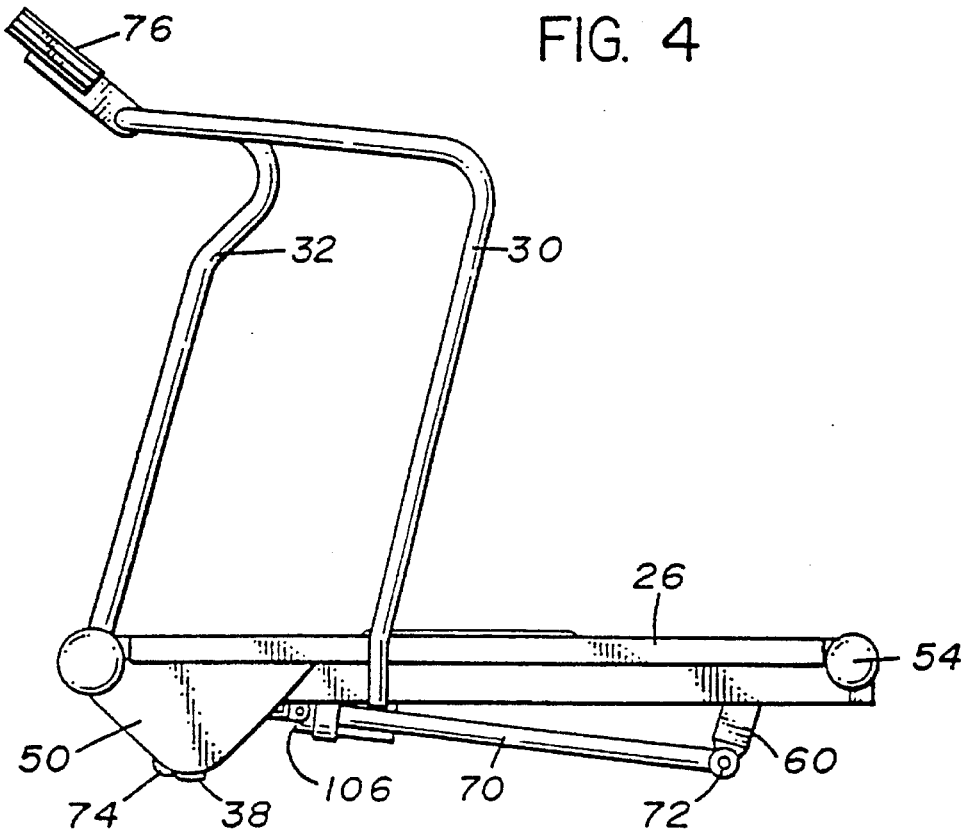
FIG. 4 is a left side elevational view thereof.
Figure 5:
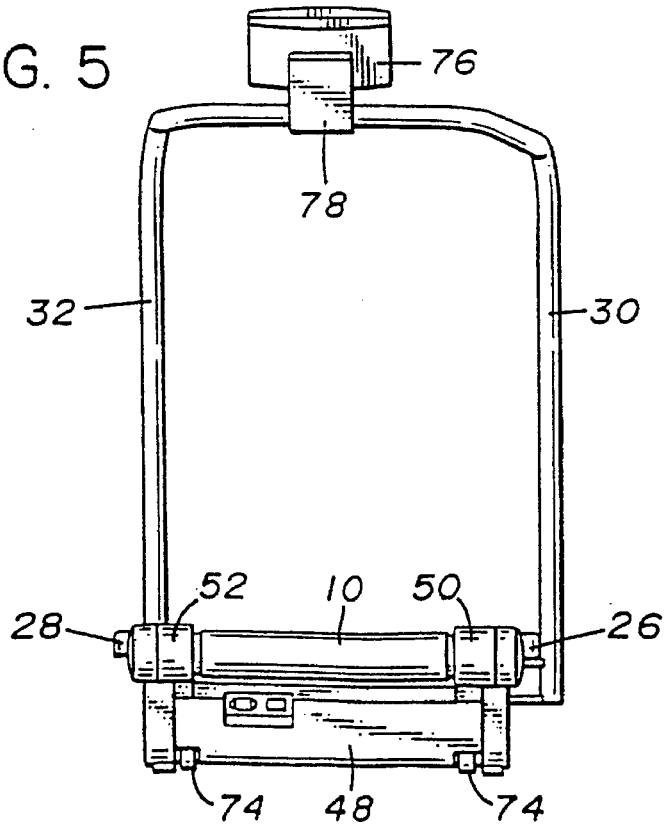
FIG. 5 is a front elevational view thereof.
Figure 6:
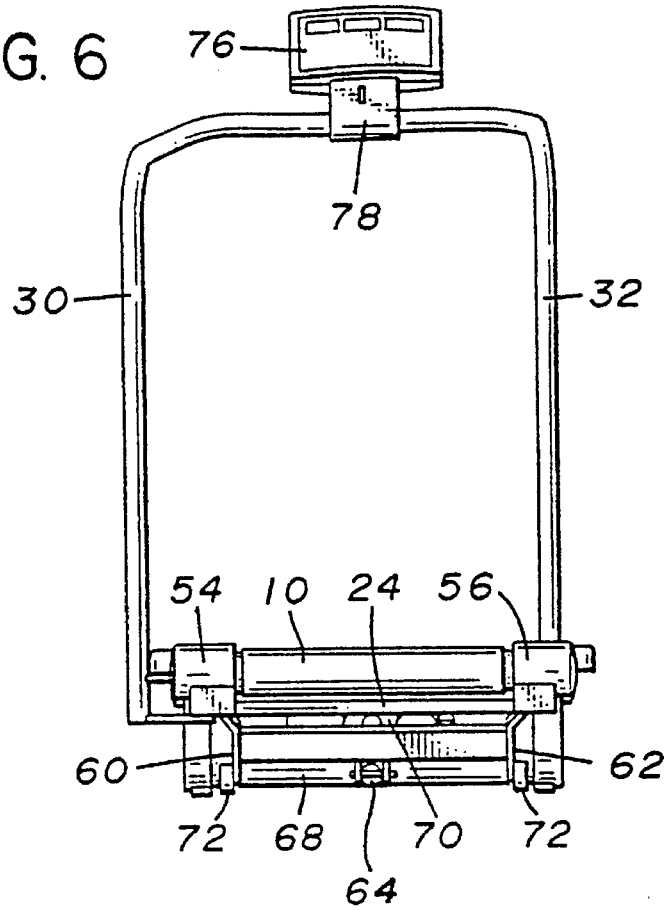
FIG. 6 is a rear elevational view thereof.
Figure 7:
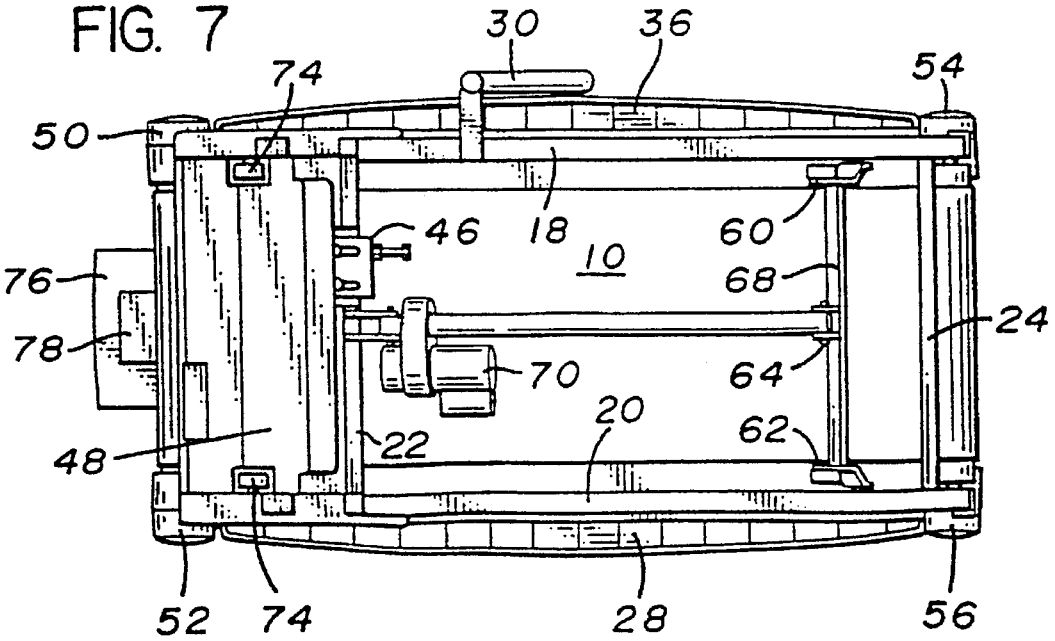
FIG. 7 is a bottom plan view thereof.

The first preferred embodiment of the invention as illustrated in FIGS. 1–8 comprises an exercise treadmill with an endless tread belt 10 which courses a front roller 12 (FIG. 8) and a rear roller 14 and with an upper course between the rollers 12, 14 which is supported by a flat tread deck 16. The rollers 12, 14 and tread deck 16 are supported by the treadmill frame which comprises side rails 18, 20 and front and rear cross members 22, 24.

As shown in FIGS. 1–8, this treadmill also comprises left and right landing strips 26, 28 along the sides of the tread belt 10, and left and right hand rails 30, 32. Below the side rails 18, 20, near the front thereof, are left and right support brackets 34, 36 which are of fixed form and terminate in their lower extremities in support surface engaging pads 38, 40.

Front roller 12, which drives the endless tread belt 10, is in turn driven by electric drive motor 42 (FIG. 8) through drive belt 44. Motor 42 is held on the frame crossbar 22 by motor bracket 46 in the region below the forward portion of the tread belt 10 and between the support brackets 34, 36. Motor cover 48 and support bracket side covers 50, 52 enclose the lower and side portions of the drive motor 42 and drive roller 12 components in a manner so that all parts of the treadmill in the forward region, except the tread belt 10 itself, are in fixed form and stationary during use. This arrangement, unique to the present invention, enables the user engaged surface of the tread belt 10, throughout its length and through the full length of the treadmill, to be completely planar, rather than the treadmill having the conventional raised forward portion which customarily is required to house the belt drive motor, and also the incline drive mechanism, when the treadmill is so equipped.

Primarily for aesthetic reasons, the ends of the rear roller 14 are provided with left and right end caps 54, 56.

According to the present invention, the first preferred embodiment thereof illustrated in FIGS. 1–8 includes an incline adjustment mechanism comprising rearwardly placed, pivotally movable left and right support arms 60, 62 which are mounted by left and right pins 64, 66 (FIG. 8) to respective side rails 18, 20 and are interconnected by a crossbar 68. Arranged between the fixed crossbar 22 and the pivotally movable crossbar 68 is an electric motor driven, extensible jack 70, which is a mechanism conventional per se, such as disclosed in Dunham U.S. Pat. No. 4,974,831. As will be apparent, the pivotally movable arms 60, 62 are slung under the frame including side rails 18, 20 and the arms 60, 62 are pivotally movable by means of the jack 70. Shortening or lengthening of the jack 70 results in change in incline of the tread belt 10. More specifically, when jack 70 is of maximum length, the arms 60, 62 are moved to a location nested between the frame side rails 18, 20, in which position the tread belt 10 has its maximum incline, i.e. with the forward end maintained in its raised position and with the rear end situated so that the rear of the frame side rails 18, 20 are in engagement with the treadmill support surface. Similarly, with the jack 70 shortened, the tread belt 10 is rendered more horizontal, i.e. less inclined.

Figure 8:
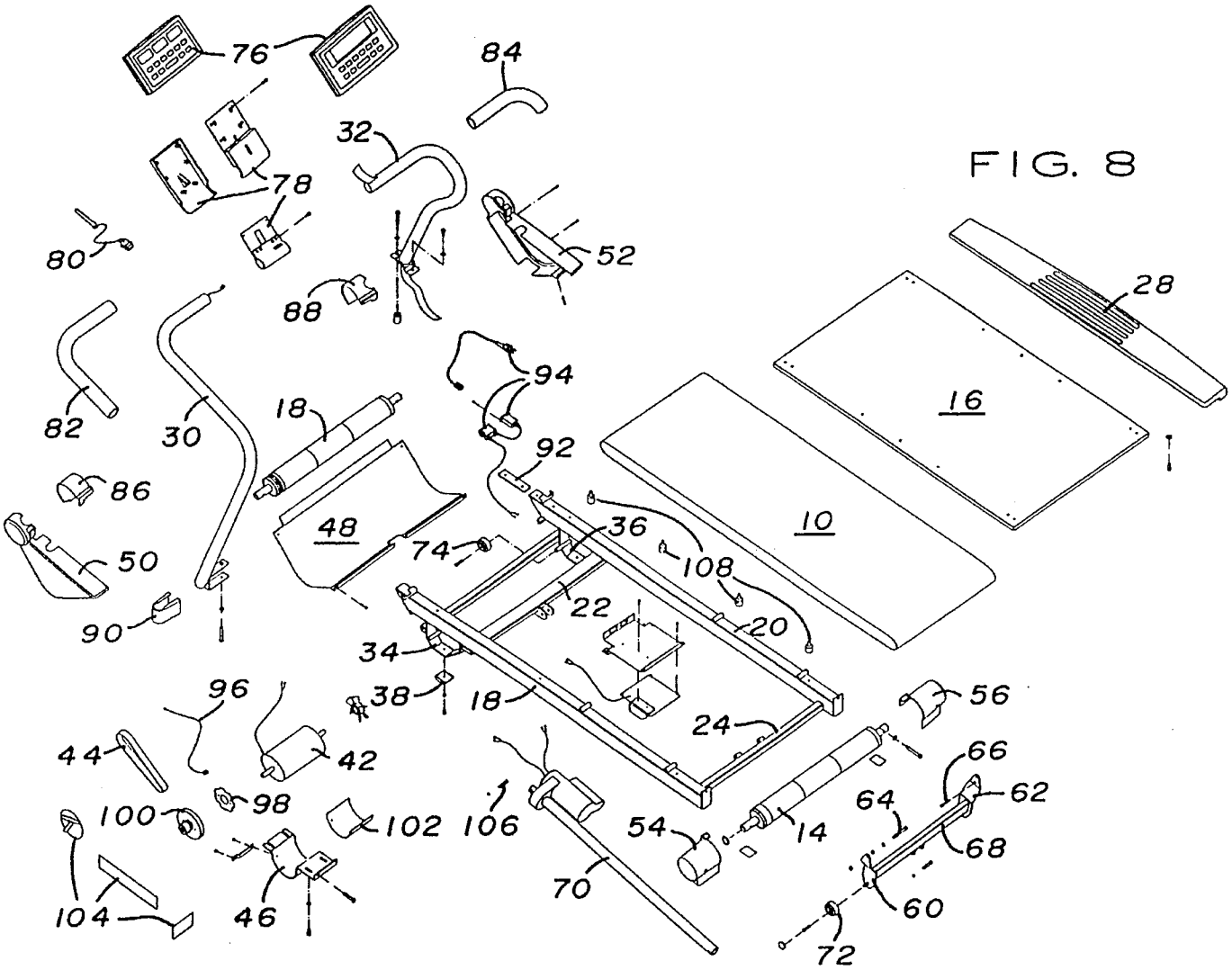
FIG. 8 is an exploded isometric view on a smaller scale of various components of the first preferred embodiment, and showing further detail as to such components.
Figure 9:
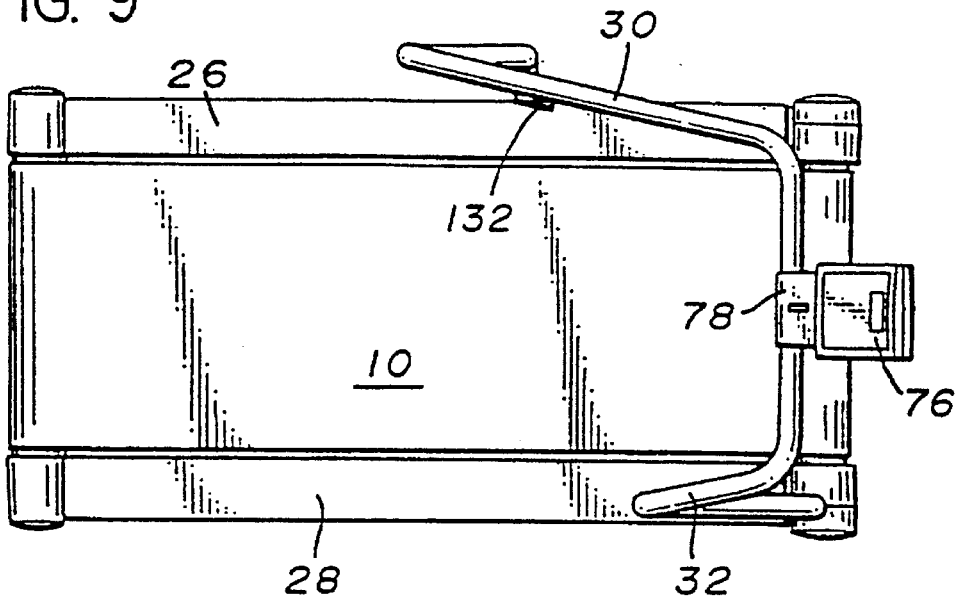
FIG. 9 is a top plan view of the second preferred embodiment thereof.
Figure 10:
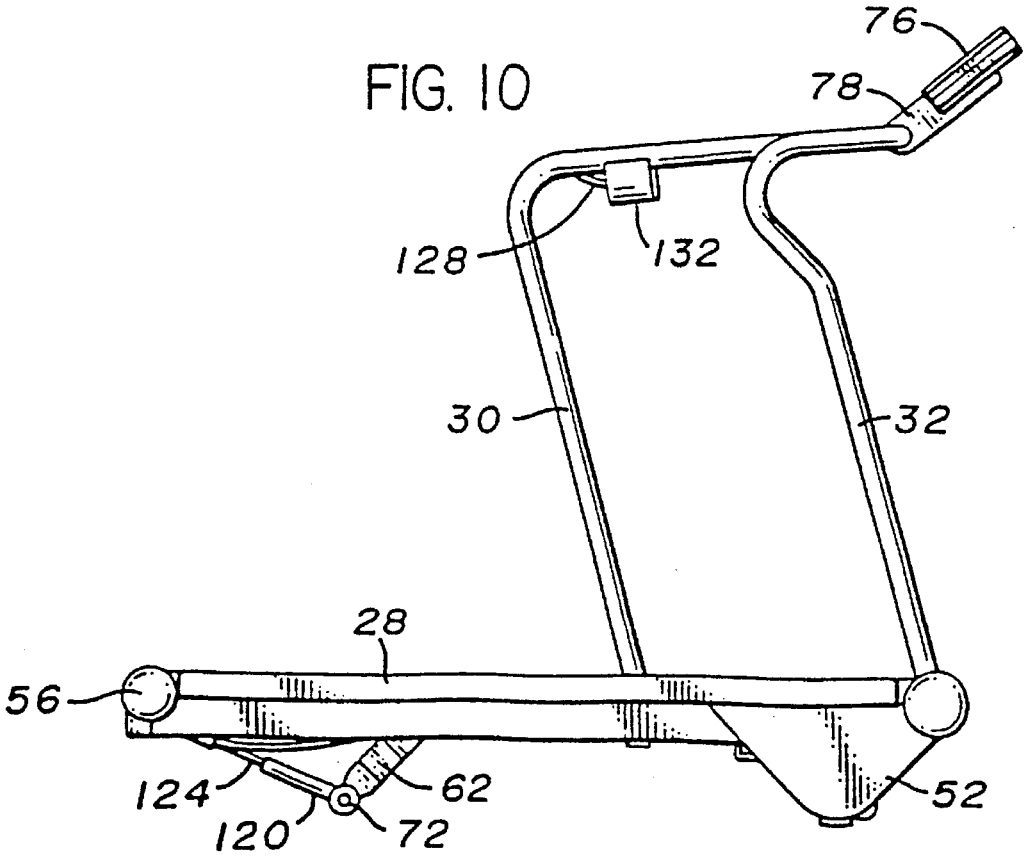
FIG. 10 is a right side elevational view thereof.
Figure 11:
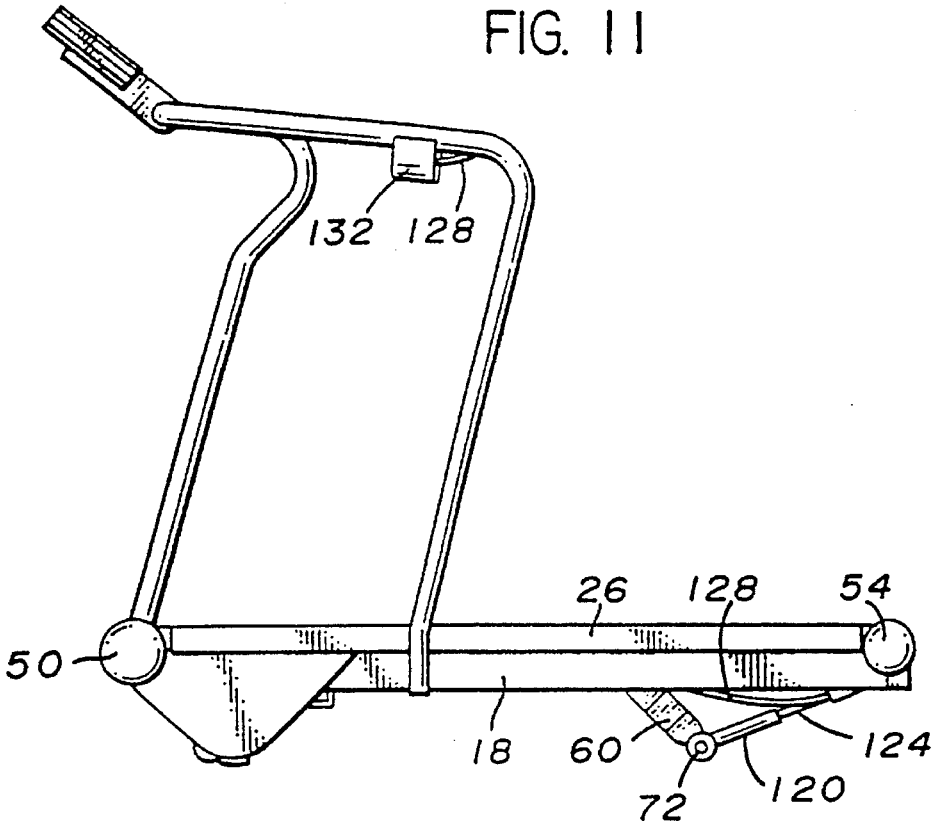
FIG. 11 is a left side elevational view thereof.
Figure 12:
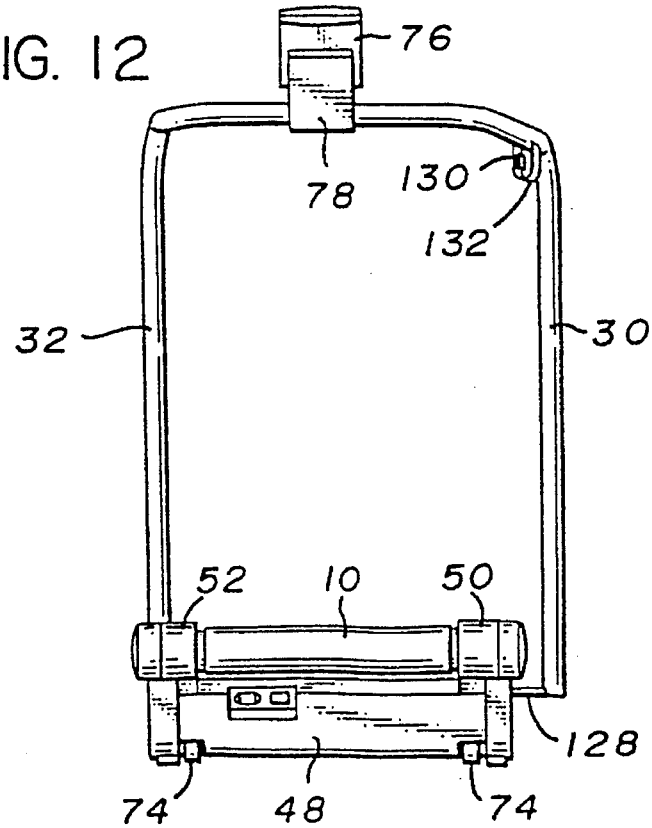
FIG. 12 is a front elevational view thereof.
Figure 13:
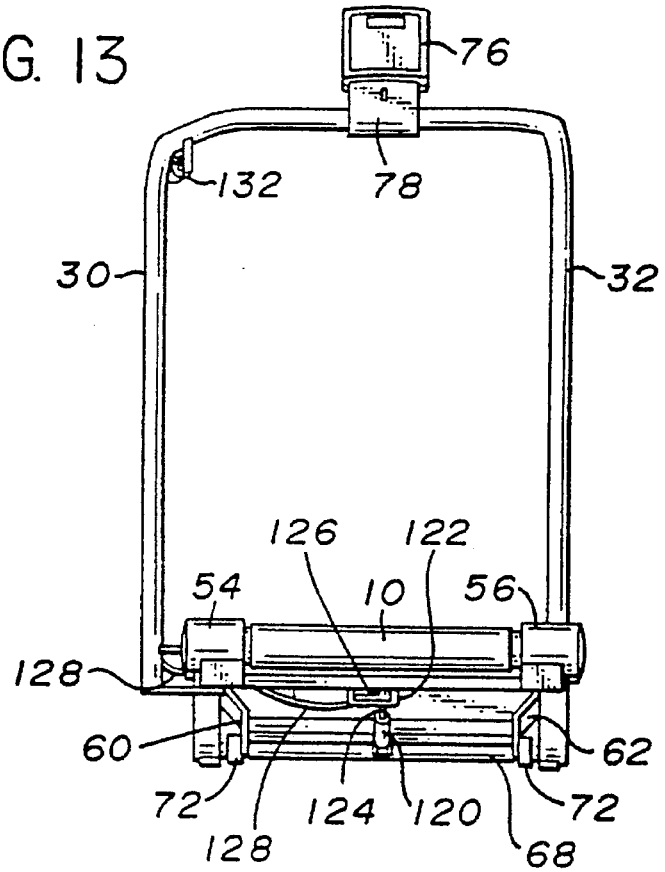
FIG. 13 is a rear elevational view thereof.

Further components of the first preferred embodiment shown in FIGS. 1–8, as they appear in the exploded view of FIG. 8, include wheels on the pivotally movable assembly including support arms 60, 62, one of which wheels is indicated at 72, and forward wheels on the forward support brackets 34, 36, one of which is indicated at 74, which facilitate movement of the treadmill when not in use. Also shown in FIG. 8 are alternatively used display panels 76, meter base components 78, tether key, cord and clip 80, left and right foam handle grips 82, 84, left front roller cap 86, right front roller cap 88, handlebar bracket cover 90, handlebar tightening bracket 92, power cable, power plug and circuit breaker 94, speed sensor and wire 96, speed sensor target disc 98, flywheel 100, drive motor bracket pad 102, decals 104, pivot pin 106 for interconnecting jack 70 and front cross member 22, and rubber bumpers 108 on which tread deck 16 rests and which in turn are supported by the side rails 18, 20.

Figure 14:
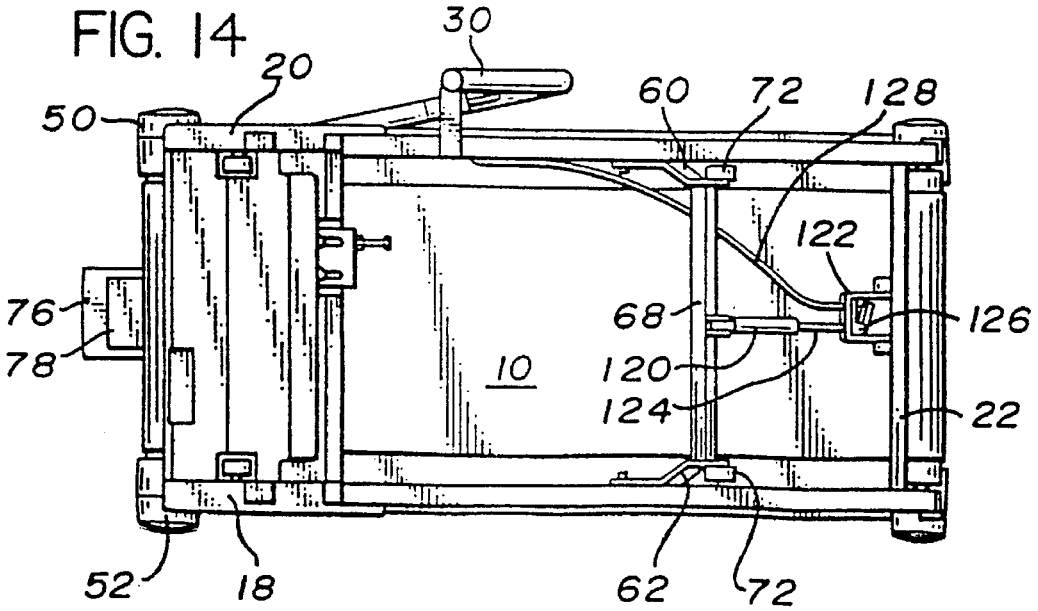
FIG. 14 is a bottom plan view thereof.

FIGS. 9–14 illustrate the second preferred embodiment of the invention. This form of treadmill is like that shown in FIGS. 1–8 except it employs a different incline adjustment mechanism. In FIGS. 9–14 components which are the same as those components shown and discussed with respect to the form of the invention shown in FIGS. 1–8 are given like component numbers and those components which are different are given different numbers. In general, this second form of the invention employs as its incline adjustment mechanism a gas cylinder 120 with a piston rod 124 extensible in length, which gas cylinder 120 and rod 124 are of a type conventional per se, such as disclosed in U.S. Pat. No. 5,192,255, for example. The gas cylinder 120 and rod 124 are interconnected between the pivot arm crossbar 68 and the rear crossbar 24 of the treadmill frame. The latter connection, as shown in FIG. 14, for example, is made through a U-shaped bracket 122 to which the rod 124 is attached and in which is housed a manual valve actuator 126. Valve actuator 126, when in a first control position (the position shown in FIG. 14), operates to maintain closed an internal valve in the cylinder 120 which when closed prevents gas flow from one end of the cylinder 120 to the other and thus maintains the piston rod 124 and the cylinder 120 stationary with the cylinder 120 and its rod 124 of fixed length, with the crossbar 68 and pivot arms 60, 62 in a set position and the treadmill deck and treadbelt 10 in a fixed incline attitude. Said valve actuator 126 has a second position whereby the internal gas valve is opened and the gas contained in the cylinder 120 can flow from one end thereof to the other and consequently permit movement of piston rod 124 and a change in overall length of the piston 120 and its rod 124, which in turn causes corresponding movement of the pivot arms 60. The position of the valve actuator 126 for either maintaining the arms 60, 62 in a fixed position or permitting movement thereof is, in the embodiment of the invention shown in FIGS. 9–14, controlled by relative lengthwise movement of a shielded, flexible control cable 128 which is led from the valve 126 through a portion of the handlebar 30 to a control lever 130 and bracket 132 on the upper portion of handlebar 30° By activation of the control lever 130 on the handlebar 30, the user of the treadmill has available the means by which to permit manual change the incline of the tread belt 10. This is done by moving the lever 130 to open the valve mechanism controlled by the valve actuator 126, whereupon gas in the cylinder 120 is free to be moved to either lengthen or shorten the piston rod 124 relative to the cylinder 120. This is done by the user shifting his or her weight forwardly or rearwardly on the tread belt 10 to the point where the treadmill frame moves pivotally and a desired angle of incline is reached, whereupon the user shifts the control lever 130 and consequently the valve actuator 126 close the internal valve in the cylinder 120 to maintain the then existing length of the piston rod 124 in the cylinder 120 and the then existing incline attitude of the pivot arms 60, 62 and thus the then existing angle of incline of the tread belt 10.

As earlier indicated, the change in incline by use of a gas cylinder and the manual change of position of the user on the tread belt is a relatively simple mechanism for the purpose. However, being manual, it does not have the advantage of an electric motor drive such as the electric motor driven incline drive mechanism of the first embodiment, for incline adjustment, which can be pre-programmed to automatically vary the tread belt incline at desired intervals.

From the foregoing, these and other adaptations, variations and modifications of the mechanisms and component arrangements shown and discussed will occur to those skilled in the art to which the invention is addressed, within the scope of the following claims.

What is claimed is:

1. An exercise treadmill comprising:

a rigid frame including side rails extending longitudinally from front to rear of said treadmill;

tread belt rollers between said side rails at the front and rear of said treadmill;

an endless tread belt carried by said tread belt rollers inboardly of said side rails;

forwardly placed support surface engaging foot means of fixed form stationarily mounted to and supporting said frame in the front portion thereof;

incline adjustment mechanism comprising left and right support arms mounted for pivotal movement on said side rails and including a movable crossbar interconnecting said support arms;

a fixed crossbar extending between said side rails below said tread belt in the forward portion of said treadmill, and extensible power means arranged between said forward crossbar and said movble crossbar for moving said rear support means to change the angular relation of said frame and said tread belt relative to said support surface; and tread belt drive motor means arranged between and below said side rails in the forward portion thereof and situated entirely below the lower course of the tread belt in the region of said forwardly placed support surface engaging means.

2. An exercise treadmill according to claim 1, wherein said extensible power means comprises an electrically powered screw jack.

3. An exercise treadmill according to claim 1, wherein said extensible power means comprises fluid cylinder means.

4. An exercise treadmill according to claim 1, wherein the condition of the treadmill on a level supporting surface with the upper course of the tread belt substantially level is with the extensible power means of the incline adjustment mechanism extended to a maximum extent and the maximum incline condition of the treadmill tread belt upper course relative to such support surface is with the extensible power means of the incline adjustment mechanism of minimal length with said left and right support arms of the incline adjustment mechanism nested between said left and right side rails and with the rearward ends of said left and right side rails engaging said support surface.

5. An exercise treadmill according to claim 4, wherein said extensible power means comprises an electrically powered screw jack means.

6. An exercise treadmill according to claim 4, wherein said extensible power means comprises fluid cylinder means.

* * * * *